US005263866A

United States Patent [19]

Campbell

[11] Patent Number: 5,263,866

[45] Date of Patent: Nov. 23, 1993

[54] GAME BOARD APPARATUS

[76] Inventor: Gregory S. Campbell, Rte. 3, Box 44D, Liberty, Tex. 77575

[21] Appl. No.: 939,660

[22] Filed: Sep. 3, 1992

[51] Int. Cl.[5] ..... B43L 1/00; B43L 1/10

[52] U.S. Cl. ..... 434/416; 434/408; 434/413; 434/415; 434/430; 434/247; 434/248; 434/251

[58] Field of Search ..... 434/408, 409, 413, 416, 434/415, 422, 423, 430, 247, 248, 251, 168

[56] References Cited

U.S. PATENT DOCUMENTS

| | | | |
|---|---|---|---|
| 1,927,695 | 9/1933 | Andreas | 434/251 |
| 2,158,368 | 5/1939 | Hurt | 434/251 |
| 3,336,682 | 8/1967 | Genin | 434/416 |
| 3,831,295 | 8/1974 | McKay | 434/168 X |
| 4,676,527 | 6/1987 | Palmer | 434/248 X |
| 4,931,019 | 6/1990 | Park | 434/409 |
| 5,131,849 | 7/1992 | Perrero | 434/408 X |
| 5,163,845 | 11/1992 | Biassingame | 434/408 |
| 5,163,846 | 11/1992 | Lee | 434/408 |

FOREIGN PATENT DOCUMENTS

| | | | |
|---|---|---|---|
| 1206548 | 8/1958 | France | 434/430 |

*Primary Examiner*—Gene Mancene
*Assistant Examiner*—L. Thomas
*Attorney, Agent, or Firm*—Leon Gilden

[57] ABSTRACT

A portable game board structure is arranged to provide for coaches and the like to illustrate various plays and examples relative to a game playing situation. The game board includes a rigid perimeter having a central opening, with one of a plurality of game boards mounted to the perimeter centrally oriented relative to the opening. Clip structure mounted relative to the opening is arranged to selectively secure the game boards thereto, with magnetic tokens utilized to indicate opposing teams in illustrative strategy play. The tokens, as well as a white writing instrument, are magnetically adhered to a perimeter frame portion of the game board apparatus.

4 Claims, 4 Drawing Sheets

GAME BOARD APPARATUS

BACKGROUND OF THE INVENTION

1. Field of the Invention

The field of invention relates to illustrative apparatus, and more particularly pertains to a new and improved game board apparatus arranged to visually indicate various aspects of game play.

2. Description of the Prior Art

Magnetic positioning toy structure for magnetically adhering various components are exemplified in the prior art in U.S. Pat. Nos. 4,566,195; 4,888,374; with drawing devices utilized in the U.S. Pat. Nos. 3,444,623; and 4,970,792.

The instant invention addresses deficiencies of the prior art by providing for a game board structure permitting ease of illustration relative to sporting events to assist coaches and the like for the illustrative assistance in game strategy planning by coaches and the like.

SUMMARY OF THE INVENTION

In view of the foregoing disadvantages inherent in the known types of drawing devices now present in the prior art, the present invention provides a game board apparatus wherein the same utilizes magnetically mounted components permitting the ease of portability and illustration relative to game playing. As such, the general purpose of the present invention, which will be described subsequently in greater detail, is to provide a new and improved game board apparatus which has all the advantages of the prior art game board apparatus and none of the disadvantages.

To attain this, the present invention provides a portable game board structure arranged to provide for coaches and the like to illustrate various plays and examples relative to a game playing situation. the game board includes a rigid perimeter having a central opening, with one of a plurality of game boards mounted to the perimeter centrally oriented relative to the opening. Clip structure mounted relative to the opening is arranged to selectively secure the game boards thereto, with magnetic tokens utilized to indicate opposing teams in illustrative strategy play. The tokens, as well as a white writing instrument, are magnetically adhered to a perimeter frame portion of the game board apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game board apparatus which has all the advantages of the prior art game board apparatus and none of the disadvantages.

It is another object of the present invention to provide a new and improved game board apparatus which may be easily and efficiently manufactured and marketed.

It is a further object of the present invention to provide a new and improved game board apparatus which is of a durable and reliable construction.

An even further object of the present invention is to provide a new and improved game board apparatus which is susceptible of a low cost of manufacture with regard to both materials and labor, and which accordingly is then susceptible of low prices of sale to the consuming public, thereby making such game board apparatus economically available to the buying public.

Still yet another object of the present invention is to provide a new and improved game board apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Figure 6:
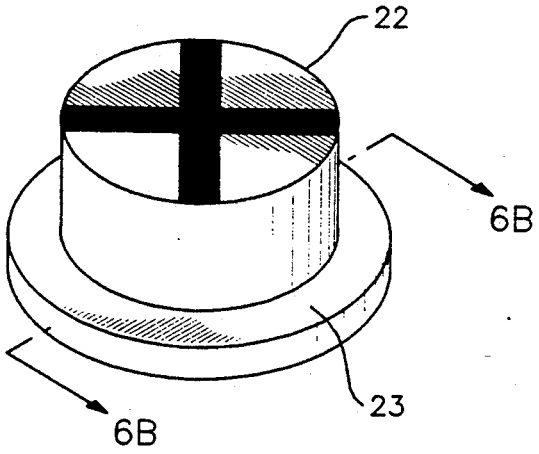
FIGS. 6 and 7 are isometric illustrations of tokens utilized by the invention.

FIG. **6*b* is an orthographic view, taken along the lines 6*b*—6*b* of FIG. 6** in the direction indicated by the arrows.

Figure 7:
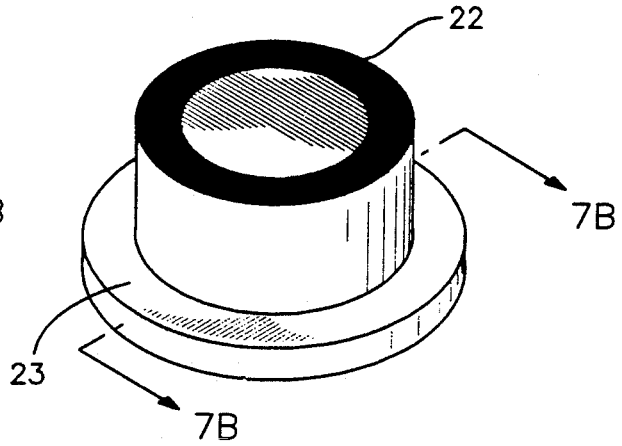
Figure 6B:
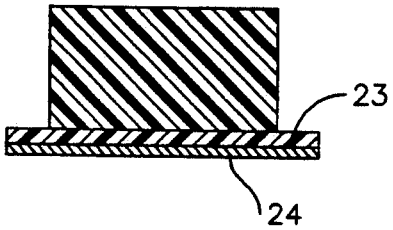
Figure 7B:
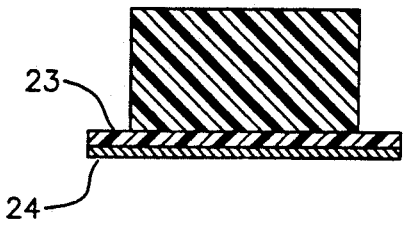

FIG. **7*b* is an orthographic view, taken along the lines 7*b*—7*b* of FIG. 7** in the direction indicated by the arrows.

Figure 8:
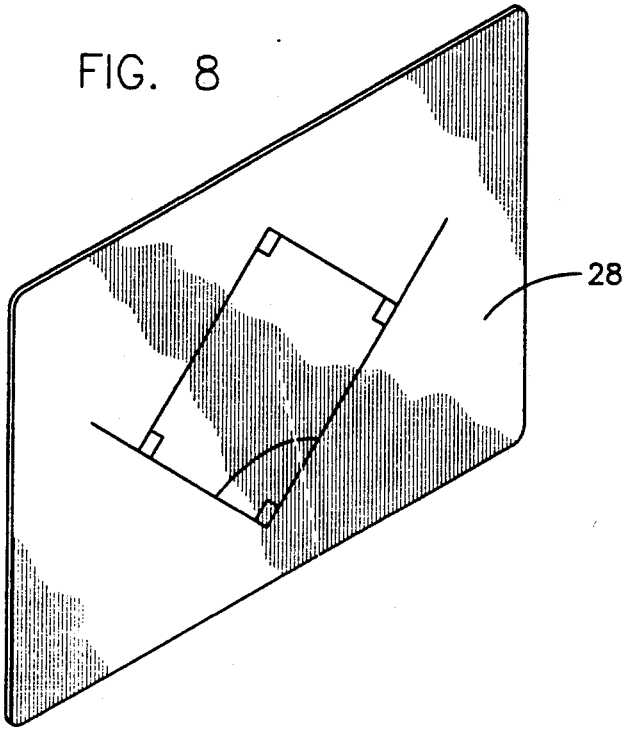
Figure 9:
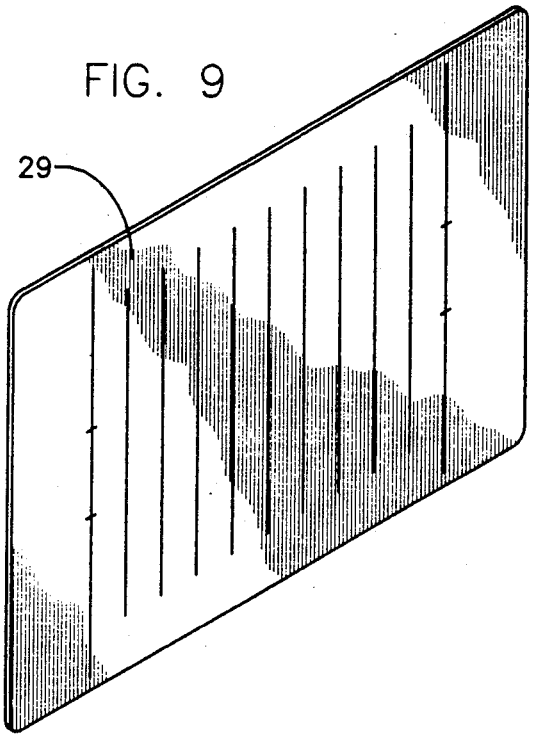
Figure 10:
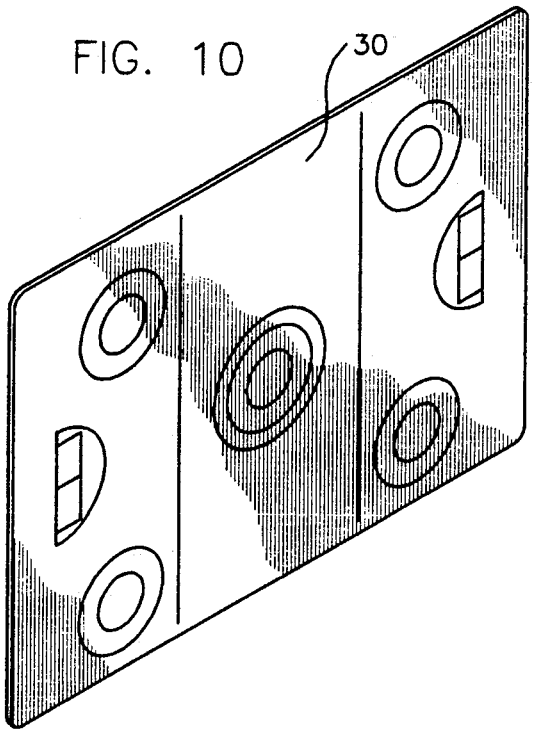

FIG. 8, FIG. 9, and FIG. 10 are isometric illustrations of supplementary game plates utilized by the invention.

DESCRIPTION OF THE PREFERRED EMBODIMENT

With reference now to the drawings, and in particular to FIGS. 1 to 10 thereof, a new and improved game board apparatus embodying the principles and concepts of the present invention and generally designated by the reference numeral 10 will be described.

Figure 1:
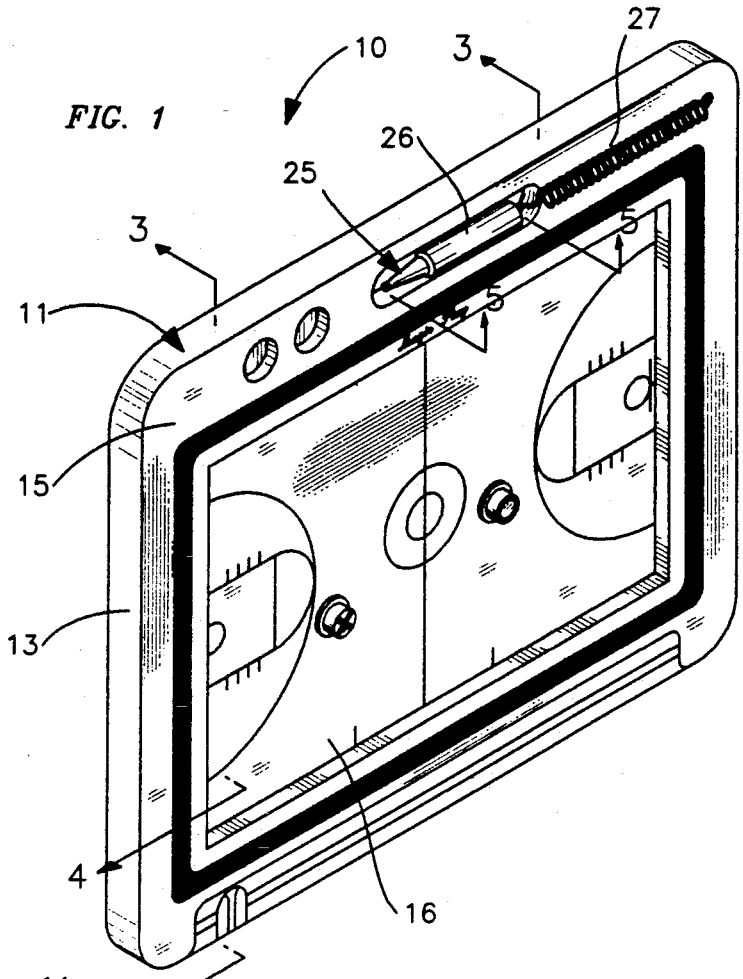
FIG. 1 is an isometric illustration of the instant invention.
Figure 2:
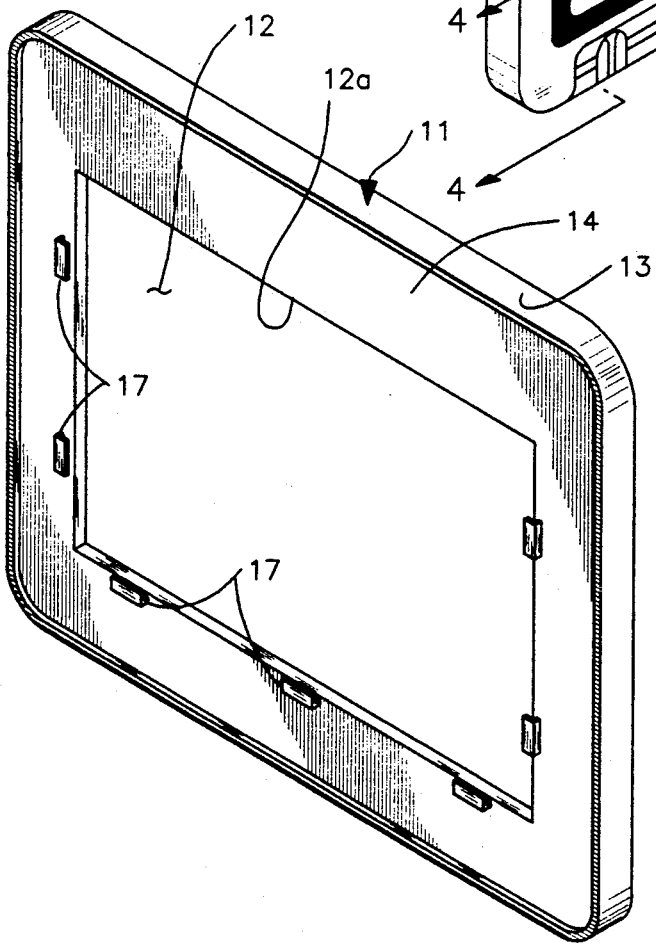
FIG. 2 is an isometric rear view of the invention.
Figure 3:
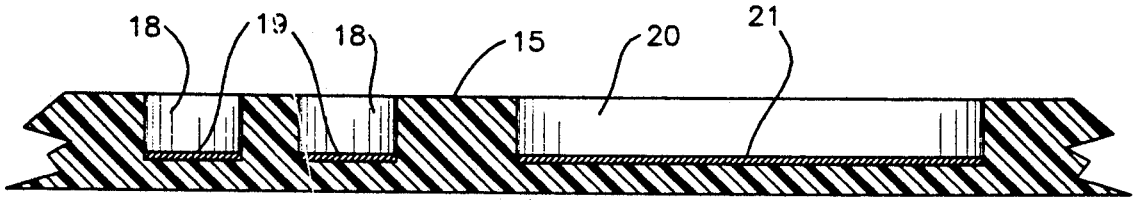
FIG. 3 is an orthographic view, taken along the lines 3—3 of FIG. 1 in the direction indicated by the arrows.
Figure 4:
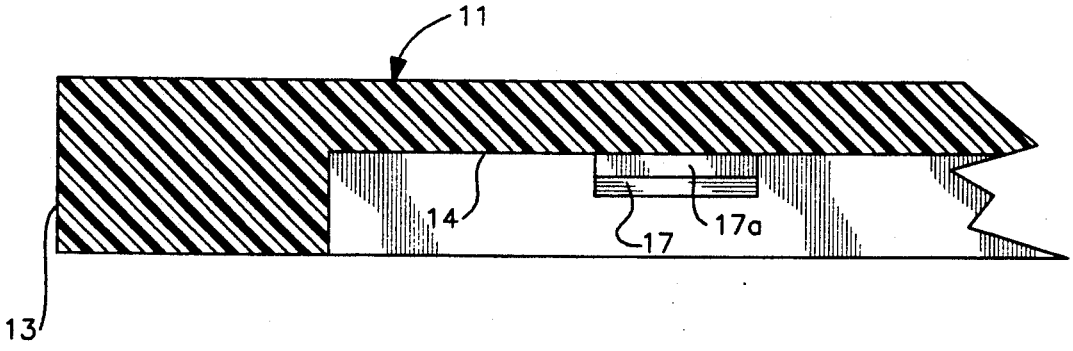
FIG. 4 is an orthographic view, taken along the lines 4—4 of FIG. 1 in the direction indicated by the arrows.
Figure 5:
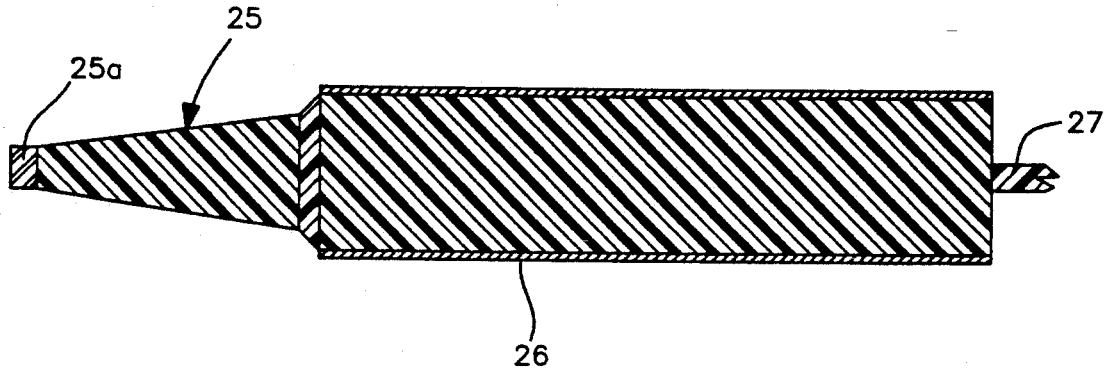
FIG. 5 is an orthographic view, taken along the lines 5—5 of FIG. 1 in the direction indicated by the arrows.

More specifically, the game board apparatus 10 of the instant invention essentially comprises a portable, easily manipulated game board structure permitting ease of illustration to illustrate various strategies of plays by a coach during play of a sporting event, and wherein the apparatus essentially comprises, a rigid perimeter frame 11 having a central opening 12 having a central opening side wall 12*a* continuously oriented about the opening. A frame side wall skirt 13 fixedly mounted to the perimeter frame 11 extends peripherally of the perimeter frame and projects beyond a frame bottom surface 14. The frame bottom surface 14 is spaced from and generally parallel relative to a frame top surface 15. A rigid ferrous metallic game plate 16 is provided secured within board mounting clips 17. The board mounting clips 17 are mounted to the frame bottom surface 14 projecting to the central opening side wall 12*a*. The clip 17 may be of a spring biased construction or are typically of a ferromagnetic construction to magnetically adhere the game plate 16. The clips 17 are mounted adjacent opposed end walls and one of the plurality of side walls of the central opening side wall 12*a* to permit positioning of the game plate 16 into the clips 17 from an opposed side wall of the plurality of side walls, in a manner as indicated in FIG. 2. The game plate 16 for illustrative purposes is of a basketball format visible through the central opening 12 relative to the top surface 15, wherein replacement first, second, and third game plates 28, 29, and 30 are provided of respective baseball, football, and hockey playing fields for viewing through the opening 12, in a manner as indicated in FIG. 1 for example. The FIG. 4 indicates the orientation of one of the magnetic clips 17 providing for a plate receiving slot 17*a* interposed between the clip and the frame bottom surface 14. The FIG. 3 illustrates a plurality of token wells 18 directed into the perimeter frame 11 from the top surface 15 spaced from the central opening 12. Each of the wells 18 includes a metallic well plate floor 19. The wells are arranged to each receive a token member 22 (see the FIGS. 6, 6*b*, 7, and 7*b*) wherein each of the tokens includes a token base 23 having a magnetic base plate 24. The magnetic base plates 24 permits selective adherence of each of the tokens to the well plate floors and selectively to the metallic game plate 16 or one of the replacement plates 28, 29, and 30 for illustrating various game strategies by a coach or instructor. To further assist, a writing instrument 25 is provided, having the writing instrument tip 25*a*, with an elongate body having a cylindrical magnetic sleeve 26 formed in surrounding relationship relative to the body. The writing instrument 25 is arranged for reception within a writing instrument cavity directed into the frame 11 from the top surface 15, with the instrument cavity 20 having an instrument cavity floor 21 of ferrous metallic construction to permit selective adherence of the writing instrument 25 into the cavity floor 21 or selectively onto the game plate during use of the instrument. To prevent loss of the instrument, a spring tether 27 is mounted from the instrument 25 at a rear distal end of the body 26 at a first end of the spring tether 27, wherein a second end of the spring tether is mounted to the frame top surface 15.

In this manner, the instrument may be utilized to permit writing upon the game plate 16 or one of the replacement plates 28-30, with the game tokens assisting in illustration of the various opposing teams and players. It should be understood that additional token wells and tokens may be provided as required, but for purposes of illustration, it should be noted that at least tokens representative of opposing teams are provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game board apparatus, comprising, a rigid perimeter frame, the perimeter frame having a central opening, with the central opening including an opening side wall, the perimeter frame having a frame top surface and a frame bottom surface, with the opening side wall orthogonally oriented relative to the frame bottom surface and the frame top surface, and the perimeter frame having a frame side wall skirt mounted fixedly and peripherally of the perimeter frame extending beyond the frame bottom surface, the central opening side wall including a plurality of end walls in confronting relationship relative to one another, and a first side wall and a second side wall, wherein the plurality of end wall and at least the first side wall each include a plurality of mounting clips, wherein each of the mounting clips are fixedly mounted to the frame bottom surface extending in adjacency to the opening side wall, with the frame side wall skirt extending beyond the mounting clips, and a plurality of game plates, wherein each of the game plates is selectively mounted within the mounting clips in contiguous communication with the frame bottom surface, and the mounting clips are of ferromagnetic construction, and each of the game plates is of a ferrous metallic construction to magnetically adhere in a selective manner one of the game plates to the mounting clips.

2. An apparatus as set forth in claim 1 wherein each of the mounting clips includes a plate receiving slot oriented between each mounting clip and the frame bottom surface.

3. An apparatus as set forth in claim 2 including a plurality of token wells directed into the perimeter frame extending from the frame top surface, wherein each of the token wells includes a metallic well plate floor, and a plurality of token members, with one of the plurality of token members directed into each of the token wells, wherein each of the token members includes a token base and each token base includes a ferromagnetic base plate for magnetic and selective adherence to one of the metallic well plate floors and to one of said game plates mounted within the central opening.

4. An apparatus as set forth in claim 3 including a writing instrument having a first distal end, and the writing instrument including a writing tip at the first distal end of the writing instrument, and the writing instrument including an elongate body, wherein the body includes a ferromagnetic sleeve extending in surrounding relationship relative to the body, wherein the body further includes a spring tether having a first end and a second end, wherein the first end of the spring tether is mounted to the body and the second end of the spring tether is fixedly mounted to the perimeter frame, the perimeter frame including a writing instrument cavity, and the writing instrument cavity includes a metallic cavity floor to permit magnetic adherence of the writing instrument to the metallic cavity floor and in a selective manner to one of said game plates mounted within the central opening.

* * * * *